US007997757B2

(12) United States Patent
Patrick

(10) Patent No.: US 7,997,757 B2
(45) Date of Patent: Aug. 16, 2011

(54) LUMINAIRE WITH INTEGRAL SIGNAGE ENDCAPS

(75) Inventor: Ellis W. Patrick, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 343 days.

(21) Appl. No.: 12/138,916

(22) Filed: Jun. 13, 2008

(65) Prior Publication Data

US 2009/0310361 A1 Dec. 17, 2009

(51) Int. Cl.
*F21V 1/00* (2006.01)

(52) U.S. Cl. ..... 362/217.02; 40/541

(58) Field of Classification Search ..... 362/217.01, 362/217.02, 217.08, 217.09, 227, 235, 249.16; 40/541, 542, 564, 570, 580
See application file for complete search history.

(56) References Cited

U.S. PATENT DOCUMENTS

| | | | | |
|---|---|---|---|---|
| 1,761,868 | A * | 6/1930 | Burke | 40/580 |
| 2,560,729 | A | 7/1951 | Lynn et al. | |
| 3,030,497 | A | 4/1962 | Cheng | |
| 4,136,474 | A * | 1/1979 | Belokin, Jr. | 40/559 |
| 4,525,391 | A | 6/1985 | Eckberg | |
| 4,535,391 | A | 8/1985 | Hsiao | |
| 5,025,355 | A * | 6/1991 | Harwood | 362/147 |
| 5,103,382 | A | 4/1992 | Kondo et al. | |
| 5,428,897 | A | 7/1995 | Jordan et al. | |
| 5,479,327 | A | 12/1995 | Chen | |
| 5,913,617 | A * | 6/1999 | Helstern | 40/564 |
| 6,286,586 | B2 | 9/2001 | Cook | |
| 6,295,203 | B1 | 9/2001 | Lo | |
| 6,299,327 | B1 | 10/2001 | Camarota | |
| 6,361,186 | B1 | 3/2002 | Slayden | |
| 6,415,853 | B1 | 7/2002 | Tao et al. | |
| 6,606,808 | B2 | 8/2003 | Katz | |
| 6,644,387 | B1 | 11/2003 | Lee et al. | |
| 6,813,155 | B2 | 11/2004 | Lo | |
| 6,841,804 | B1 | 1/2005 | Chen et al. | |
| 7,090,375 | B2 | 8/2006 | Kuisma | |
| 7,121,684 | B2 | 10/2006 | Barozzini et al. | |
| 7,157,694 | B2 | 1/2007 | May et al. | |
| 7,175,313 | B2 | 2/2007 | Bednara et al. | |
| D551,795 | S | 9/2007 | Compton et al. | |
| 7,286,296 | B2 | 10/2007 | Chaves et al. | |
| 7,336,492 | B2 | 2/2008 | Yu | |
| 7,374,310 | B2 | 5/2008 | Barozzini et al. | |
| 7,591,578 | B2 | 9/2009 | Chang | |

(Continued)

OTHER PUBLICATIONS

McGraw-Edison Installation Instructions; Oct. 1999.

*Primary Examiner* — Julie Shallenberger
(74) *Attorney, Agent, or Firm* — King & Spalding LLP

(57) ABSTRACT

A luminaire with signage endcaps includes a luminaire housing and one or more light emitting elements. The housing typically includes a top member and multiple side members extending down from the top member. The top and side members define the interior of the luminaire housing. Light emitting elements are coupled to the housing. These light emitting elements generally emit light downward from the luminaire and can be coupled along the interior of the housing or positioned along an exterior side of one or more of the side members. A stencil or stencil plate can be positioned along or coupled to one or more others side members. The stencil and stencil plate include openings in the shape of alphanumeric symbols and/or ideograms and include within the openings or have positioned adjacent to the openings a translucent member. Ambient light within the interior of the housing illuminates the stencil and translucent member.

20 Claims, 4 Drawing Sheets

U.S. PATENT DOCUMENTS

| | | | |
|---|---|---|---|
| 7,887,216 | B2 | 2/2011 | Patrick |
| 2004/0080938 | A1 | 4/2004 | Holman et al. |
| 2005/0157500 | A1 | 7/2005 | Chen et al. |
| 2005/0265019 | A1 | 12/2005 | Sommers et al. |
| 2007/0206384 | A1 | 9/2007 | Compton et al. |
| 2007/0217216 | A1 | 9/2007 | Goto et al. |
| 2008/0037239 | A1 | 2/2008 | Thomas et al. |
| 2009/0225549 | A1 | 9/2009 | Patrick et al. |
| 2009/0310330 | A1 | 12/2009 | Vann et al. |
| 2009/0310361 | A1 | 12/2009 | Patrick et al. |
| 2009/0321598 | A1 | 12/2009 | Vann |
| 2010/0182782 | A1 | 7/2010 | Ladewig et al. |

* cited by examiner

LUMINAIRE WITH INTEGRAL SIGNAGE ENDCAPS

FIELD OF THE INVENTION

This invention relates generally to lighting systems for parking garage facilities. More particularly, the invention relates to a linear parking garage luminaire with signage integrated into one or more of the sides or endcaps along the exterior of parking garage luminaire.

BACKGROUND

The garage building industry puts a great deal of time and effort in designing its path of egress and safety standards. With the potential for substandard light levels and poor visibility within the parking garage the industry tries to do that which is within reason to maintain a safe environment within the parking garage. To help provide a safer environment within the parking garage, many garages include signage or directionals (such as arrows, ideograms, or other symbols) that provide information to people within automobiles. This information can include the direction of allowable traffic flow along a certain level or lane within the garage, whether turns are required or allowed, the location of certain landmarks (such as a store, office building, or historical area adjacent the parking garage) the location of additional parking, and the direction to the exit of the garage. In addition, signage or directionals can be provided for pedestrians within the parking garage. This signage can include, but is not limited to, arrows directing the pedestrian towards a path of egress, an elevator, a stairway, an emergency exit, an emergency callbox, or the like.

Many conventional parking garages include both luminaires for illuminating the interior of the parking garage and the signage or advertising for directing drivers or pedestrians within the parking garage towards the exit or other paths of egress. The signage can include a self contained source of illumination or it can be standard signage that is not illuminated.

However, there is a problem with signage that is not illuminated, in that it can be difficult to see and discern within a poorly lit parking garage. Even if the parking garage is well lit, the majority of the light being put off by the luminaires within the parking garage is directed downward. Further, most of the signage is coupled to or suspended from the ceiling at a level at or above the level of the garage luminaire. Thus, little, if any, of the light generated by the luminaire illuminates the signage.

While the signage that includes its own source of illumination overcomes the problem of effectively illuminating the sign it typically requires that additional electrical work be done within the parking garage to run power sources to each of these illuminated signs. This additional electrical work can significantly increase costs in constructing the parking garage. Further, when additional signage is needed after the garage is completed, additional cost and time is necessary to install illuminated signage instead of the standard non-illuminated signage.

Accordingly, there is a need in the art for a garage luminaire that incorporates and illuminates signage or directionals within the housing of the garage luminaire.

SUMMARY OF THE INVENTION

A luminaire with signage endcaps includes a luminaire housing and one or more light emitting elements. The housing typically includes a top member and multiple side members extending down from the top member. The top and side members define the interior of the luminaire housing. Light emitting elements are coupled to the housing. These light emitting elements generally emit light downward from the luminaire and can be coupled along the interior of the housing or positioned along an exterior side of one or more of the side members. A stencil or stencil plate can be positioned along or coupled to one or more others side members. The stencil and stencil plate include openings in the shape of alphanumeric symbols and/or ideograms and include within the openings or have positioned adjacent to the openings a translucent member. Ambient light within the interior of the housing illuminates the stencil and translucent member.

For one aspect of the present invention, the garage luminaire includes a luminaire housing that can have an interior and an exterior. A portion of the exterior of the luminaire housing can be opaque. The luminaire can also include one or more light emitting elements that are attached to the luminaire housing. The light emitting elements, such as lamps or light emitting diodes, direct at least some of their light away from the luminaire housing. A sign or stencil can be positioned along the exterior of the housing and can be illuminated by ambient light from within the interior of the luminaire housing.

For another aspect of the present invention, the garage luminaire includes a housing that can have a generally horizontal top member and multiple side members. The top and side members can define the interior of the housing. A channel can extend along all or most of the exterior of one or more of the side members and can include an optically reflective surface. A row of LEDs can be positioned within the channel. A stencil can be positioned along the exterior of one or more of the side members and can include openings through the side members and a translucent member next to or within the openings. The translucent member can be illuminated by the ambient light from within the interior of the housing.

For yet another aspect of the present invention, the garage luminaire can have a generally rectangular housing. The housing can typically include a horizontal top member, two elongated side members, and a pair of endcaps positioned along the end of each of the elongated side members. A light emitting element can be coupled to the housing. The luminaire can also include one or more stencils positioned along one or both of the endcaps. The stencil can include a translucent material that is illuminated by the ambient light within the interior of the luminaire housing.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
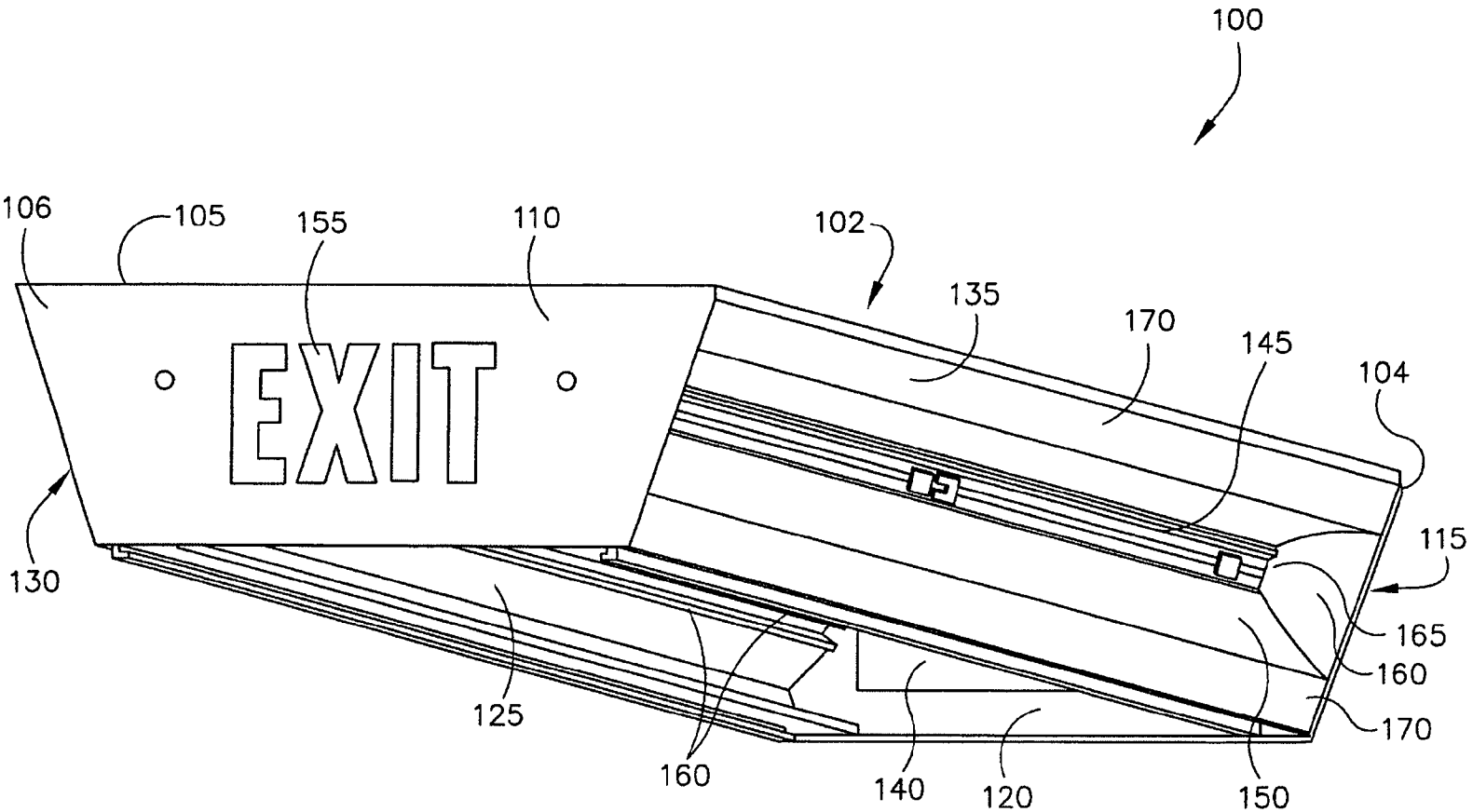
FIG. 1 is a perspective view of a linear garage luminaire with signage endcaps according to one exemplary embodiment of the present invention.

Many aspects of the invention can be better understood with reference to the above drawings. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION OF THE EXEMPLARY EMBODIMENTS

The present invention is directed to a luminaire used in parking garages and other areas where there is a need to provide signage and/or directional information to drivers of automobiles and/or pedestrians. The inventive functionality of the luminaire with signage endcaps will be explained in more detail in the following description and is disclosed in conjunction with the presented figures.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Figure 2:
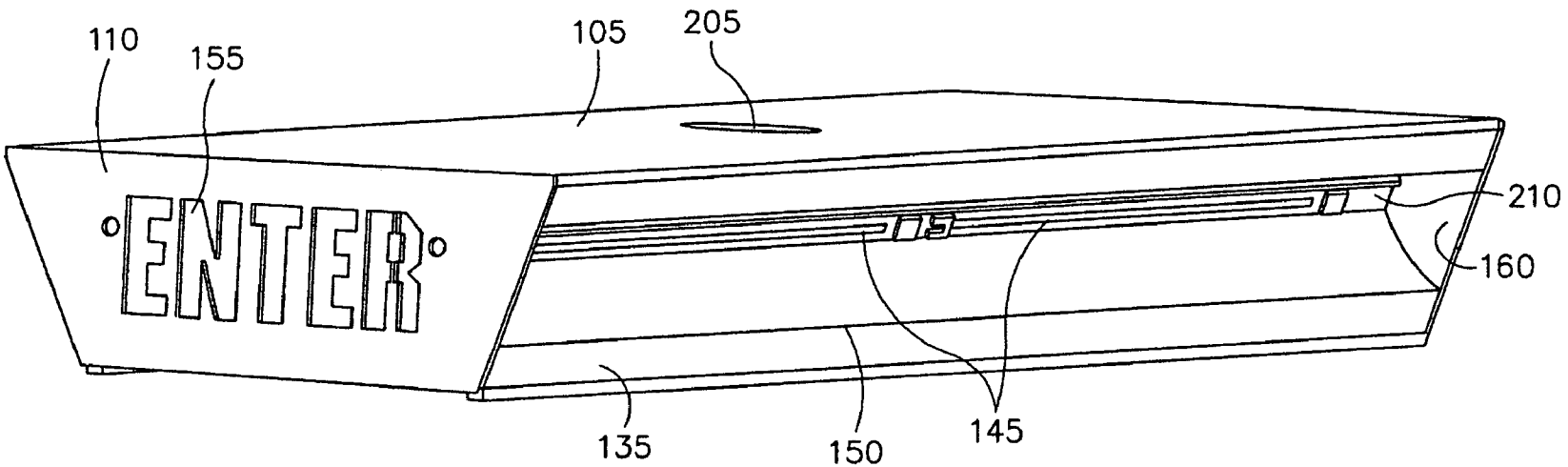
FIG. 2 is another perspective view of the linear garage luminaire of FIG. 1 in accordance with one exemplary embodiment of the present invention.
Figure 3:
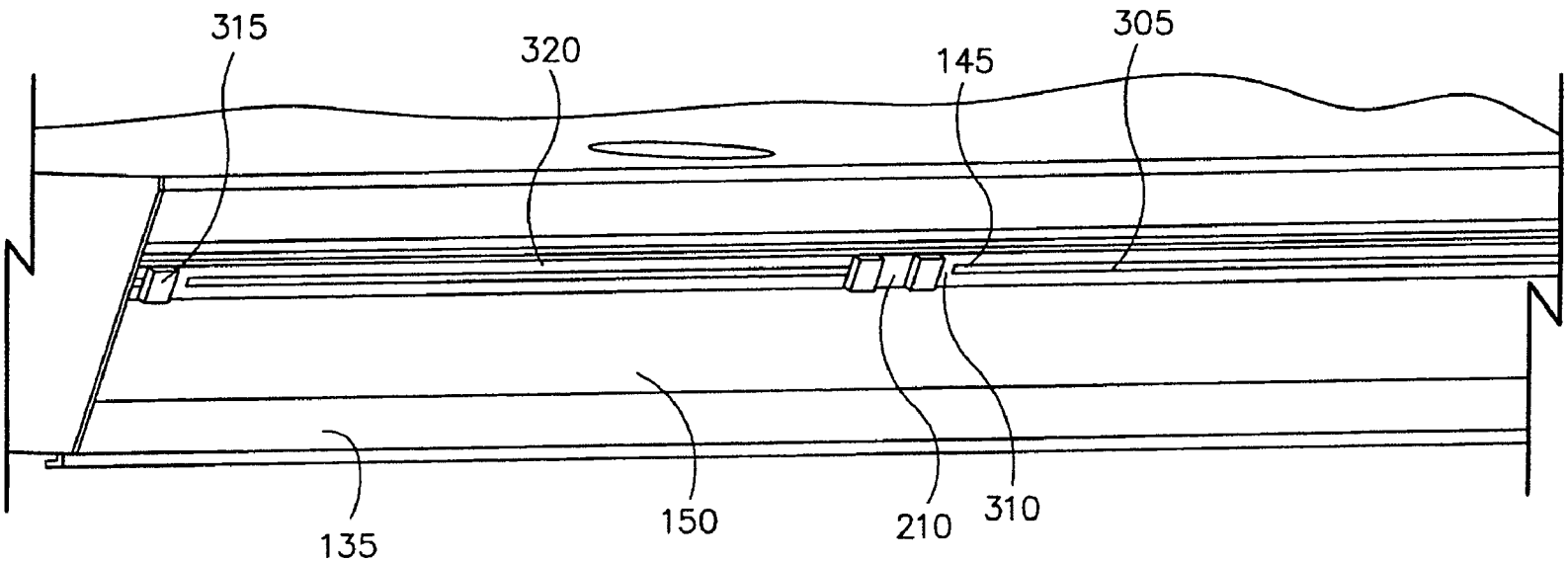
FIG. 3 is a partial elevational perspective view of the linear garage luminaire of FIG. 1, highlighting the light emitting elements for the luminaire in accordance with one exemplary embodiment of the present invention.

Referring now to the drawings in which like numerals represent like elements throughout the several figures, aspects of the present invention will be described. FIGS. 1-3 show perspective views of the luminaire 100, or lighting fixture, for illuminating a space or an area that people may occupy or observe. In one exemplary embodiment, the luminaire 100 can be a luminaire suited for mounting to a ceiling of a parking garage or a similar structure.

The term "luminaire," as used herein, generally refers to a system for producing, controlling, and/or distributing light for illumination. A luminaire can be a system for outputting or distributing light into an environment so that people can observe items in the environment. Such a system could be a complete lighting unit comprising: one or more LEDs for converting electrical energy into light; sockets, connectors, or receptacles for mechanically mounting and/or electrically connecting components to the system; optical elements for distributing light; and mechanical components for supporting or attaching the luminaire. Luminaires are sometimes referred to as "lighting fixtures" or as "light fixtures." A lighting fixture that has a socket for a light source, but no light source installed in the socket, can still be considered a luminaire. That is, a lighting system lacking some provision for full operability may still fit the definition of a luminaire.

Now referring to FIGS. 1-3, the exemplary garage luminaire 100 can include an optically transmissive cover (not shown) attached over the luminaire housing 102 to provide protection from dirt, dust, moisture, etc. Such a cover can control light via refraction or diffusion, for example. In addition, the cover can help maintain some of the light within the cover to increase the ambient light levels within an interior 125 of the luminaire housing 102. This ambient light provides sufficient light to illuminate the signage 155, which will be discussed in greater detail hereinafter. Moreover, the cover can be configured as a refractor, a lens, an optic, or a milky plastic or glass element.

The luminaire 100 includes a luminaire housing 102. As illustrated in FIG. 2, the luminaire housing 102 includes a generally flat or horizontal top cover 105 that faces the ceiling (or other surface) to which the lighting system 100 is mounted. In certain exemplary embodiments, the top cover 105 includes an aperture (not shown), typically centered along the housing 102 for receiving an electrical supply of power from the ceiling or mounting surface. In addition, the exemplary cover 105 includes a mounting member (not shown) and one or more coupling devices (not shown), such as screws, for mounting the luminaire 100 to the ceiling or mounting structure.

The exemplary luminaire housing 102 is generally rectangular in shape. Other shapes that the exemplary luminaire 100 conforms to includes, but is not limited to, oval, circular, diamond-shaped, or any other geometric or irregular form. The housing 102 generally includes two longitudinal side sections 130, 135 and two ends 104, 106. The luminaire housing 102 also includes a channel 165 extending substantially along each of the longitudinal side sections 130, 135. Two extrusions 170 define the channel 165. A row of LEDs 145 is disposed in each of the channels 165. Each channel 165 includes a reflective surface 150 for manipulating light from the associated row of LEDs 145. In certain exemplary embodiment, the reflective surface 150 includes a lining of the channel 165, a film or coating of reflective or optical material applied to the channel 165, or a surface finish of the channel 165.

In one exemplary embodiment, the channel 165 has a uniform or homogenous composition, and the reflective surface 150 comprises a polished surface. Thus, the exemplary reflective surface 150 is formed by polishing the channel 165 itself to support specular reflection or roughening the surface 150 for a diffuse reflection.

In one or more exemplary embodiments, each channel 165 includes a groove, a furrow, a trench, a slot, a trough, an extended cavity, a longitudinal opening, or a concave structure running lengthwise. A channel 165 can include an open space as well as the physical structure defining that space. In other words, the channel 165 can include both a longitudinal space that is partially open and the sidewalls of that space.

In one exemplary embodiment, the reflective surfaces 150 are polished so as to be shiny or mirrored. In another exemplary embodiment, the reflective surfaces 150 are roughened to provide diffuse reflection. In another exemplary embodiment, each reflective surface 150 comprises a metallic coating or a metallic finish. For example, each reflective surface 150 includes a film of chromium or some other metal applied to a substrate of plastic or another material. In yet another exemplary embodiment, a conformal coating or a vapor-deposited coating can provide reflectivity.

In one exemplary embodiment, each extrusion 170 has an aluminum composition or includes aluminum. As an alternative to fabrication via an extruding process, the channel 165 can be machined/cut into a bar of aluminum or other suitable metal, plastic, or composite material. Such machining includes milling, routing, or another suitable forming/shaping process involving material removal. In certain exemplary embodiments, the channels 165 are formed via molding, casting, or die-based material processing. In one exemplary embodiment, the channels 165 are formed by bending strips of metal.

Each extrusion 170 includes fins 160 opposite the channel 165 for managing heat produced by the associated row of LEDs 145. In an exemplary embodiment, the fins 160 and the channel 165 of each extrusion 170 are formed in one fabrication pass. That is, the fins 160 and the channel 165 are formed during extrusion, as the extrusion 170 is extruded.

As illustrated, the fins 160 of each extrusion 170 run or extend alongside, specifically behind, the associated channel 165. As discussed in further detail below, heat transfers from the LEDs 145 via a heat-transfer path extending from the row of LEDs 145 to the fins 160. The fins 160 receive the conducted heat and transfer the conducted heat to the surrounding environment (typically air) via convection.

The two extrusions 170 extend along the exterior of each longitudinal side section 130, 135 and in combination with the ends 106 of the luminaire housing 102 define a central opening 125, or interior, of the luminaire housing 102 that supports convection-based cooling. An enclosure (not shown) located in the central opening 125 contains electrical support components, such as wiring, drivers, power supplies, terminals, connections, etc. In one exemplary embodiment, the enclosure includes a junction box or "j-box" for connecting the luminaire 100 to an electrical power source. Alternatively, the luminaire housing 102 includes a separate junction box (not illustrated) located above the luminaire housing 102.

With regards more specifically to FIGS. 2 and 3, a detailed view of a portion of the exemplary luminaire 100 housing the LEDs 145 is provided. In the exemplary embodiment, the row of LEDs 145 is attached to a flat area 210 of the associated extrusion 170. The term "row," as used herein, generally refers to an arrangement or a configuration whereby items are disposed approximately in or along a line. Items in a row are not necessarily in perfect alignment with one another. Accordingly, one or more elements in the row of LEDs 145 might be slightly out of perfect alignment, for example, in connection with manufacturing tolerances or assembly deviations. Moreover, elements might be purposely staggered.

The row of LEDs 145 includes one or more modules, each comprising at least one solid state light emitter or LED, represented at the reference number "305." Each of these modules is viewed as an exemplary embodiment of an LED 305 and thus, will be referred to hereinafter as LED 305. In another exemplary embodiment, an LED is a single light emitting component (without necessarily being included in a module or housing potentially containing other items).

Each LED 305 is attached to a respective substrate 310, which includes one or more sheets of ceramic, metal, laminates, or circuit board material, for example. The attachment between the LED 305 and the substrate 310 includes a solder joint, a plug, an epoxy or bonding line, or another suitable provision for mounting an electrical/optical device on a surface. Support circuitry 315 is also mounted on each substrate 310 for supplying electrical power and control to the associated LED 305. The support circuitry 315 includes one or more transistors, operational amplifiers, resistors, controllers, digital logic elements, etc. for controlling and powering the LED 305.

In one exemplary embodiment, each substrate 310 adjoins, contacts, or touches the flat area 210 of the extrusion 170 onto which each substrate 310 is mounted. Accordingly, the thermal path between each LED 305 and the associated fins 160 can be a continuous path of solid or thermally conductive material. In one exemplary embodiment, that path can be void of any air interfaces, but may include multiple interfaces between various solid materials having distinct thermal conductivity properties. In other words, heat can flow from each LED 305 to the associated fins 160 freely or without substantive interruption or interference.

The substrates 310 attach to the flat areas 210 of the extrusion 170 via solder, braze, welds, glue, plug-and-socket connections, epoxy, rivets, clamps, fasteners, etc. A ridge 320 provides an alignment surface so that each substrate 310 makes contact with the ridge 320. Moreover, contact between the substrates 310 and the ridge 320 provides an efficient thermal path from the LEDs 305 to the extrusion 170, and onto the fins 160, as discussed above. Accordingly, substrate-to-extrusion contact (physical contact and/or thermal contact) occurs at the flat area 210, at the ridge 320, or at both the flat area 210 and the ridge 320.

In an exemplary embodiment, the LEDs 305 include semiconductor diodes emitting incoherent light when electrically biased in a forward direction of a p-n junction. In an exemplary embodiment, each LED 305 emits blue or ultraviolet light, and the emitted light excites a phosphor that in turn emits red-shifted light. The LEDs 305 and the phosphors can collectively emit blue and red-shifted light that essentially matches blackbody radiation. Moreover, the emitted light may approximate or emulate incandescent light to a human observer. In one exemplary embodiment, the LEDs 305 and their associated phosphors emit substantially white light that may seem slightly blue, green, red, yellow, orange, or some other color or tint. Exemplary embodiments of the LEDs 305 include indium gallium nitride ("InGaN") or gallium nitride ("GaN") for emitting blue light.

In an alternative embodiment, multiple LED elements (not shown) are mounted on each substrate 310 as a group. Each such mounted LED element can produce a distinct color of light. Meanwhile, the group of LED elements mounted on one substrate 310 can collectively produce substantially white light or light emulating a blackbody radiator.

In one exemplary embodiment, some of the LEDs 305 produce red light, while others produce, blue, green, orange, or red, for example. Thus, the row of LEDs 145 can provide a spatial gradient of colors.

In one exemplary embodiment, optically transparent or clear material (not shown) encapsulates each LED 305, either individually or collectively. Thus, one body of optical material can encapsulate multiple light emitters. Such an encapsulating material includes a conformal coating, a silicone gel, cured/curable polymer, adhesive, or some other material that provides environmental protection while transmitting light. In one exemplary embodiment, phosphors, for converting blue light to light of another color, are coated onto or dispersed in such encapsulating material.

Returning primarily to FIGS. 1 and 2, the exemplary housing 102 further includes endcaps 110, 115 positioned along each end 104, 106 respectively. In one exemplary embodiment, each endcap 110, 115 is substantially orthogonal to each longitudinal side section 130, 135. Each endcap 110, 115 includes signage 155 incorporated into, coupled to, or integral with the endcap 110, 115. In one exemplary embodiment, the signage 155 is a stencil in one or both of the endcaps 110, 115. The stencil can include alphanumeric symbols combined to create words or ideograms or a combination of both words and ideograms, as shown in 405 of FIG. 4A and 410 of FIG. 4B. The words and ideograms are those typically used within a parking garage, such as "exit", "enter", "do not enter" "additional parking", "no entrance", "one-way", "emergency", "assistance", "stores", "call-box", "open", "closed", arrows in any direction, and/or ideograms, such as, a circle with a slash through it. Within the stencil are one or more diffuser plates 415. Each diffuser plate 415 is typically formed of a translucent plastic material and is positioned within or adjacent to all or a portion of an opening created in the stencil to represent the letter or ideogram for the signage 155. Alternatively, a single diffuser plate can be used that is dimensioned to cover the entire signage 155 and is coupled along the interior side 120 of each endcap 110, 115. The diffuser plate 415 can be modified to be almost any color through the use of colored gels applied to the translucent plastic material including, but not limited to, red, blue, green, yellow, orange, and white. In each of the exemplary diffuser plate embodiments described above, the housing 102 includes coupling a diffuse material along with a colored film to the endcaps 110, 115.

Figure 4A:
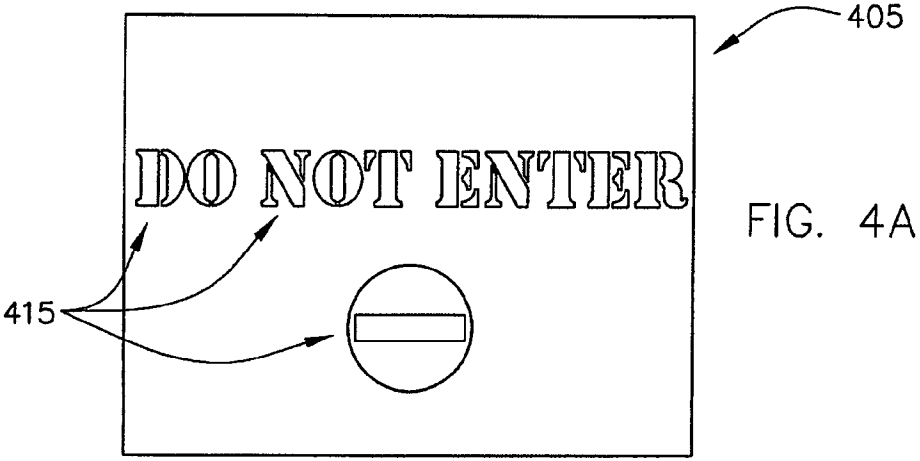
FIGS. 4A and 4B are elevational views of endcaps with exemplary signage and ideograms according to one exemplary embodiment of the present invention.
Figure 4B:
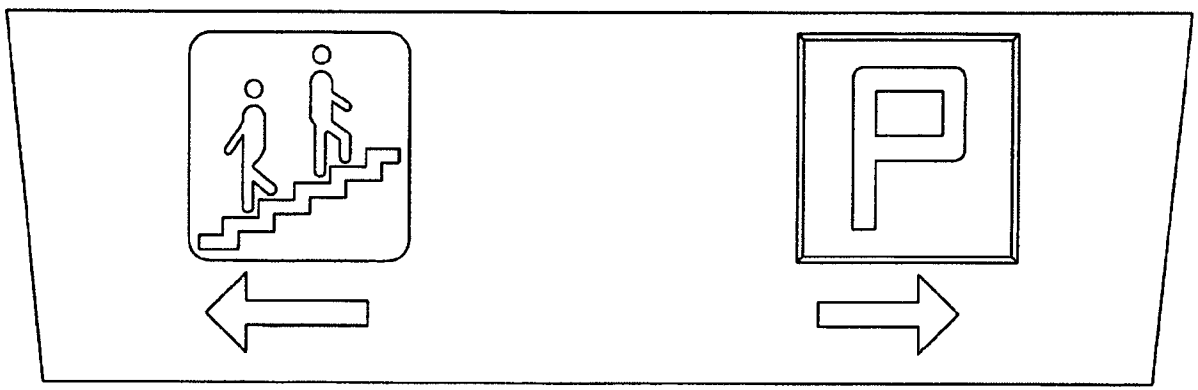

In an alternative embodiment, each endcap 110, 115 includes an aperture (not shown) dimensioned to receive a stencil plate, such as the plate 405 of FIG. 4A. Each endcap 110, 115 may also include mounting holes or channels for receiving and coupling each stencil plate to its respective endcap 110, 115. The stencil plate 405 is typically a plate made of a metallic, semi-metallic, plastic, or composite material. In one exemplary embodiment, the stencil plate 405 has a substantially rectangular shape. The stencil plate 405 further includes certain alphanumeric symbols combined to make words or known abbreviations or ideograms, such as those discussed above, that have been cut-out of the plate to create holes through the plate. The stencil plate 405 is coupled or slidably inserted into one of the apertures of the endcaps 110, 115 using the channels, mounting holes, or a combination thereof. Thus, the stencil plate 405 would have an exterior side facing out from the endcap 110, 115 and an interior side 140 facing towards the interior 125 of the housing 102.

A diffuser plate (not shown) is disposed along the interior side 140 of the stencil plate 405. In one exemplary embodiment, the diffuser plate is coupled to its respective endcap 110, 115. In an alternative embodiment incorporating channels along the aperture in each endcap 110, 115, the diffuser plate is positioned within the channel adjacent the interior side 140 of the stencil plate 405. As with the diffuser plate 415 described above, this diffuser plate of this alternative embodiment can be modified to be almost any color through the use of colored gels applied to the translucent plastic material including, but not limited to, red, blue, green, yellow, orange, and white.

In one exemplary embodiment, the luminaire housing 102 further includes light transmission channels 160 positioned along each end of the longitudinal side sections 130, 135. Each light transmission channel 160 includes one or more openings between the end of the channel 165 and the respective endcap 110, 115, where light emitted from the LEDs 145 is capable of passing therethrough to provide illumination to the signage 155. In an alternative embodiment, instead of, or in addition to, the incorporation of a light transmission channel 160, the luminaire cover (not shown), described above, is capable of reflecting a sufficient amount of the light generated by the LEDs into the interior 125 of the luminaire housing 102, so that the signage 155 is illuminated with the ambient light within the interior 125. In an alternative embodiment (not shown), one or more LEDs 145 are positioned adjacent to the signage 155 along the interior 140 of the endcap 110, 115 to provide illumination to the signage 155.

In another alternative embodiment (not shown), the housing 102 includes fluorescent lamps instead of LEDs. The fluorescent lamps span the interior 125 and are coupled to sockets positioned along the interior 120 of each of the endcaps 110, 115. The bottom side of the top cover 105 can further include a reflective surface for manipulating light from the fluorescent lamps downward and away from the housing 102. The reflective surface can include a lining of the bottom side of the top cover 105, a film or coating of reflective or optical material applied to the bottom side of the top cover 105, or a surface finish of the top cover 105. The reflective surface is substantially similar to that described with reference to the channel 165. In this alternative embodiment, in addition to or in place of the fluorescent lamps within the interior 125 of the housing 102, fluorescent lamps can be positioned in the channels 165 along each of the longitudinal side sections 135 and attached to sockets disposed along the interior side 120 of the endcaps 110, 115. In this alternative embodiment, light emitted from the fluorescent lamps provides sufficient ambient light within the housing 102 to illuminate one or more of the signage 155 along each of the endcaps 110, 115. While the alternative embodiment is described above with reference to the use of fluorescent lamps, those of ordinary skill in the art will recognize that other types of lamps could be used with the novel housing 102 with only minor changes to the sockets, electrical components, or housing dimensions, including, but not limited to, a high intensity discharge lamp, a pulse start metal halide, a high pressure sodium lamp, or a compact fluorescent lamp, and are within the scope and teaching of the present invention.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A garage luminaire comprising;

a luminaire housing comprising:

a substantially rectangular shape;

a substantially horizontal top member; and a plurality of side members extending down from the top member and comprising:

two elongated sides;

a first endcap coupled to a first end of each of the elongated sides; and a second endcap coupled to a second end of each of the elongated sides, wherein the top and side members define an interior of the luminaire housing, and wherein each side member comprises an interior side and an exterior side;

each elongated side comprising a channel extending along at least a majority of the exterior of said elongated side, wherein the channel comprises an optically reflective surface;

a row of light emitting diodes (LEDs) disposed in each of the channels;

at least one stencil disposed along at least one of the endcaps and facing out from the exterior of the endcap, the stencil comprising at least one aperture and a translucent member disposed adjacent the aperture; and an optically transmissive cover coupled to the luminaire housing and reflecting at least a portion of the light emitted from the LEDs back into the interior of the housing;

wherein the translucent member is illuminated by the light reflected off the cover and into the interior of the housing.

2. A garage luminaire comprising;

a substantially rectangular luminaire housing comprising:

a substantially horizontal top member two elongated side members, each side member comprising:

a first end and a second end and coupled to the top member, wherein at least a portion of each side member extends down from the top member; and a concave, optically reflective surface forming a cavity facing out from an exterior side of the elongated side member;

a first endcap coupled to the first end of each of the elongated side members; and a second endcap coupled to the second end of each of the elongated side members, wherein the top member, side members, and endcaps define an interior of the luminaire housing;

wherein each side member and endcap comprises an interior side and the exterior side;

a plurality of light emitting elements coupled to the luminaire housing, wherein at least one of the light emitting elements is disposed within the cavity of each of the elongated side members within the cavity and comprises a light emitting diode (LED);

an optically transmissive cover coupled to the luminaire housing and reflecting at least a portion of a light emitted from the LED back into the interior of the housing; and at least one stencil disposed along at least one of the endcaps, the stencil comprising a translucent material that is illuminated by the light reflected off of the cover and into the interior of the luminaire housing.

3. The luminaire of claim 1, further comprising light emitting elements disposed within the interior of the luminaire housing.

4. The luminaire of claim 3, wherein the light emitting elements comprise fluorescent lamps.

5. The luminaire of claim 1, wherein the stencil comprises a plurality of openings, wherein a translucent member is positioned adjacent each of the openings and is illuminated by the light reflected off of the cover and into the interior of the housing.

6. The luminaire of claim 1, wherein the stencil comprise alphanumeric symbols.

7. The luminaire of claim 1, wherein the stencil comprises at least one ideogram.

8. The garage luminaire of claim 1, wherein each endcap comprises a stencil, wherein each stencil comprises a plurality of apertures presented in the shape of symbols and a translucent material, wherein the translucent material is illuminated by the light reflected off of the cover and into the interior of the housing.

9. The garage luminaire of claim 1, wherein at least one endcap comprises an aperture for receiving a stencil plate and wherein the stencil comprises the stencil plate, the stencil plate comprising an opaque material and a plurality of apertures in the opaque material presented in the shape of at least one symbol.

10. The garage luminaire of claim 9, further comprising a translucent material disposed adjacent the stencil plate along the interior side of the endcap, wherein the translucent material is illuminated by the light reflected off of the cover and into the interior of the housing.

11. The garage luminaire of claim 1, wherein the light emitting diodes emit light outward from the channel along the exterior of the elongated side.

12. The garage luminaire of claim 1, wherein the cover increases the level of the light within the interior of the housing.

13. The garage luminaire of claim 1, further comprising a plurality of protrusions disposed outside of the channel and operative to dissipate heat produced by the row of light emitting diodes.

14. The luminaire of claim 2, wherein the reflected light by the cover increases the amount of light within the luminaire housing.

15. The garage luminaire of claim 2, wherein at least a portion of the light emitting element is disposed within the interior of the luminaire housing and comprises a fluorescent lamp.

16. The luminaire of claim 2, wherein the stencil comprises a plurality of openings, wherein a translucent member is positioned within each of the openings and is illuminated by the light reflected off of the cover and into the interior of the housing.

17. The luminaire of claim 2, wherein the stencil comprise alphanumeric symbols.

18. The luminaire of claim 2, wherein the stencil comprises at least one ideogram.

19. The garage luminaire of claim 2, wherein at least a portion of the light emitting element is disposed within the interior of the luminaire housing.

20. The luminaire of claim 1, wherein the stencil comprises a plurality of openings, wherein the luminaire further comprises a plurality translucent members, each positioned within one of the plurality of stencil openings and illuminated by the light reflected off of the cover and into the interior of the housing.

* * * * *